United States Patent [19]

Kaji et al.

[11] 4,355,915

[45] Oct. 26, 1982

[54] BALL-POINT PEN TIP

[75] Inventors: Shigeru Kaji; Seiji Noguchi, both of Soka, Japan

[73] Assignee: Pentel Kabushiki Kaisha, Japan

[21] Appl. No.: 42,574

[22] Filed: May 25, 1979

[30] Foreign Application Priority Data

May 30, 1978 [JP] Japan ..... 53-63857

[51] Int. Cl.[3] ..... B43K 7/10; B43K 1/08

[52] U.S. Cl. ..... 401/216; 401/209

[58] Field of Search ..... 401/209–217

[56] References Cited

U.S. PATENT DOCUMENTS

| | | | |
|---|---|---|---|
| 1,527,971 | 3/1925 | Forsell | 401/216 |
| 2,660,151 | 11/1953 | Smith | 401/216 |
| 2,967,353 | 1/1961 | Arengo | 401/216 |
| 3,302,279 | 2/1967 | Rosa | 401/216 |
| 3,671,616 | 6/1972 | Nakata | 401/216 |
| 4,139,313 | 2/1979 | Hori | 401/216 |

FOREIGN PATENT DOCUMENTS

| | | | |
|---|---|---|---|
| 2115043 | 10/1972 | Fed. Rep. of Germany | 401/216 |
| 2210246 | 9/1973 | Fed. Rep. of Germany | 401/216 |
| 2743888 | 4/1979 | Fed. Rep. of Germany | 401/212 |
| 1003293 | 11/1951 | France | 401/216 |
| 1088078 | 9/1954 | France | 401/216 |
| 218660 | 4/1942 | Switzerland | 401/216 |
| 660784 | 11/1951 | United Kingdom | 401/216 |
| 797547 | 7/1958 | United Kingdom | 401/216 |
| 1135739 | 12/1968 | United Kingdom | 401/216 |

*Primary Examiner*—Clyde I. Coughenour

*Attorney, Agent, or Firm*—Robert E. Burns; Emmanuel J. Lobato; Bruce L. Adams

[57] ABSTRACT

A ball-point pen comprises a tip having a ball retainer at its front end for rotatably carrying a ball therein and having a through-opening formed in the ball retainer for communication with the rear end thereof, and an axial sleeve for containing a quantity of ink therein. The through-opening is formed a plurality of axially and radially extending ink guide grooves in its inner surfaces. The guide grooves have a width which is gradually narrowed toward the axis of the pen and a radial depth which is gradually reduced toward the ball retainer.

9 Claims, 4 Drawing Figures

BALL-POINT PEN TIP

FIELD OF THE INVENTION

The invention relates to a ball-point pen, and more particularly, to the construction of an ink passage which is suitable for use with a ball-point pen employing a water soluble or aqueous ink in controlling the flow of the ink from an ink chamber to a ball located at the front end of a tip.

Ball-point pens have been in widespread use for many years, and comprise a tip having a retainer at its front end in which a cup-shaped recess is formed for rotatably carrying a ball therein and having an opening formed in the bottom of the recess for communication with the rear end thereof, and an axial sleeve for containing a quantity of ink therein, the rear end of the tip being mounted on the front end of the sleeve so that ink contained within the sleeve can be led through the opening in the tip to the ball for writing purpose. An ink which is used in such ball-point pens can be categorized into two types, an oil-base ink which has been used for many years and a water soluble ink which has begun to be used recently. An oil-base ink has an increased viscosity as compared with the water soluble ink, so that an appropriate quantity of ink can be smoothly supplied to the ball as it rotates by merely forming an ink guide groove of a simple construction in the bottom of the recess or in an inner wall of the tip body which defines the through-opening so that the guide groove maintains a quantity of ink therein. When a similar guide groove is used in a ball-point pen which uses a water soluble ink, the reduced viscosity of the ink may cause a dripping of the ink during the writing process or may cause the ink to return to an ink chamber if the pen is placed upright with the tip located atop, thereby preventing an immediate re-initiation of the writing process. Thus it will be seen that the configuration of the guide groove is of a great significance in a ball-point pen using a water soluble ink.

DESCRIPTION OF THE PRIOR ART

U.S. Pat. Nos. 2,813,512, 3,302,279 and 3,781,123 disclose various configurations of a guide groove wherein the bottom of a cup-shaped recess which retains a ball is formed with a plurality of radially extending grooves which communicate with a through-opening at their one end, thereby assisting in achieving a flow of an ink into the recess to provide an increased area of contact between the ink and the ball. With an oil-base ink having an increased viscosity, it is possible to maintain an uninterrupted flow of ink from an ink chamber through the through-opening into the bottom of the recess. However, with a water soluble ink having a reduced viscosity, an amount of ink located within the through-opening may be returned to the ink chamber or may be interrupted to prevent a smooth flow of the ink into the bottom of the recess if the pen is placed upright with the tip located atop or when a shock is applied to the pen. This difficulty is overcome by U.S. Pat. No. 3,671,616 which discloses a tip having a plurality of axially extending grooves formed in the inner surface of the through-opening thereof which provide a capillary action so that the construction may be used with a water soluble ink. These grooves have a depth which is directed toward the axis of the pen. The upper end of these axial grooves opens into the bottom of the recess while their lower end opens into a cavity which communicates with an ink chamber formed by an axial sleeve, thereby improving the residence of ink within the through-opening and hence preventing an uninterrupted flow of ink. Also, Japanese Laid-Open Patent Application No. 51-47,821 discloses a further improvement of an ink supply to the through-opening from the ink chamber, by providing a plurality of radially extending grooves also in the lower end of the through-opening which adjoins with the upper end of the ink chamber.

When a tip having the groove structure as disclosed in U.S. Pat. No. 3,671,616 or Japanese Laid-Open Patent Application No. 51-47,821 is employed in a ball-point pen which utilizes a water soluble ink, there still remains the tendency for an interrupted ink flow to occur at the commencement of the writing process as well as during the writing process. As a result of investigation, it has been found that such a phenomenon is caused by a uniform width of the grooves and the fact that the grooves extend in parallel relationship with the axis or the diameter of the grooved through-opening which is tapered so as to present a gradually decreasing diameter from the bottom of the recess toward the ink chamber. Specifically, with such a construction, the capillary action provided by the grooves is not fully effective to provide a speed of ink flow which corresponds to an increased writing speed or to prevent the ink located within the grooves from returning to the ink chamber when the pen is not in use.

To alleviate the problem, Japanese Utility Model Publication No. 49-43,216 proposes the provision of axial grooves each having a width which gradually decreases toward the axis of a pen. While this groove structure improves the capillary action of the through-opening which tends to drive the ink toward the axis, the capillary action in the axial direction or in the direction of the flow of the ink from the ink chamber to the ball is less than satisfactory, still leaving the possibility of an interrupted ink flow.

SUMMARY OF THE INVENTION

It is an object of the invention to provide a ball-point pen which assures a smooth flow of ink from an axial sleeve to a ball through a through-opening and which maintains a quantity of ink within the through-opening when the pen is not in use so that the ink can be immediately led to the ball when the pen is to be used.

In accordance with the invention, there is provided a ball-point pen for use with a water soluble ink including a tip having a ball retainer at its axially front end which is formed with a cup-shaped recess which rotatably carries a ball and having a through-opening extending through the bottom of the recess and communicating with the rear end of the tip, and an axial sleeve having an ink chamber formed therein which communicates with the through-opening, the through-opening of the tip having a plurality of axially and radially extending ink guide grooves formed in its inner surface, the guide grooves having a width which is gradually narrowed toward the axis of the pen and having a radial depth which is gradually reduced toward the bottom of the recess.

Specifically, in accordance with the invention, the guide grooves assure that the capillary action of the through-opening which permits ink from an ink chamber defined by the axial sleeve to be led into the bottom of the cup-shaped recess which retains the ball gradually increases toward the axis of the through-opening and as further removed from the ink chamber and the ball is approached, thereby preventing an interrupted presence of the ink within the through-opening. The ink is smoothly led through the guide grooves toward the center of the bottom of the recess, and the guide grooves cause a radial diffusion of the ink in the bottom of the recess so that the ball which is positioned in the bottom of the recess is partly immersed in the ink. During the writing process, rotation of the ball allows the surface of the ball which is wetted by the ink to appear on a sheet of paper thus preventing the strokes from becoming thin or broken.

DESCRIPTION OF THE PREFERRED EMBODIMENTS

Figure 1:
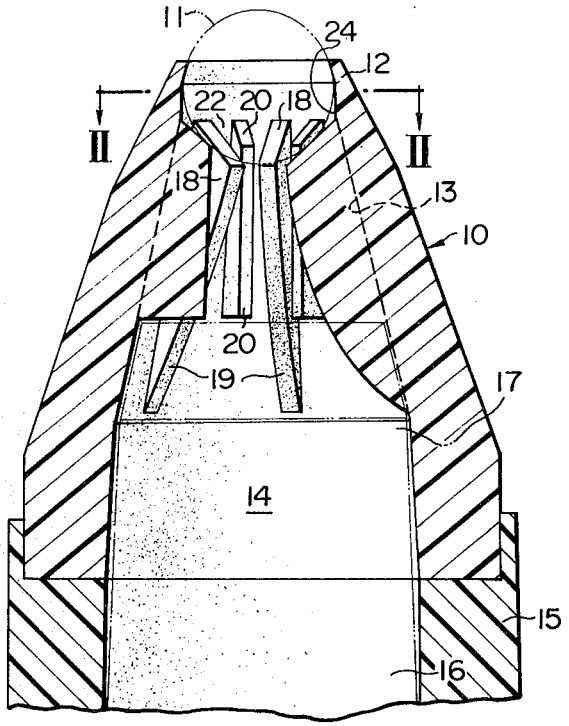
FIG. 1 is a longitudinal section of a tip of a ball-point pen according to a first embodiment of the invention.
Figure 2:
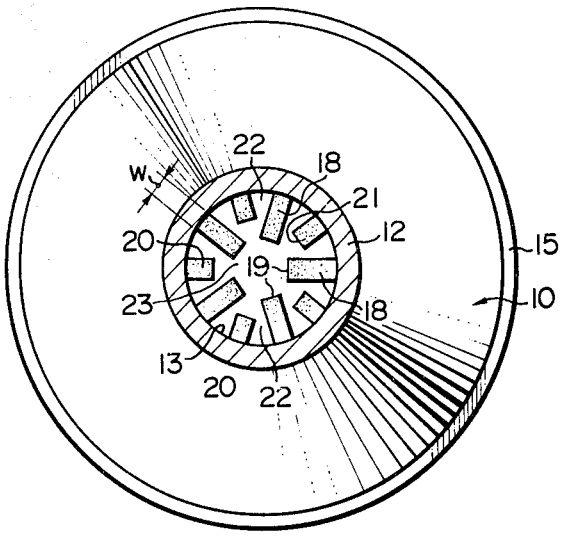
FIG. 2 is a cross section taken along the line II—II shown in FIG. 1.

Referring to FIGS. 1 and 2, there is shown a tip body generally shown by numeral 10 which is molded from a synthetic resin material. A ball 11 which is formed of a metal, synthetic resin or jewel such as ruby is rotatably carried in a ball retainer 12 formed at the front end of the tip body 10 and which defines a cup-shaped recess 24. Opening into the center of the bottom of the recess 24 is the upper end of an axially extending center opening 13 which is tapered in a conical form, presenting a diameter which gradually decreases in the axial direction toward the recess 24. Stated otherwise, the center opening 13 has a tapered shape which gradually converges in the axial direction toward the recess 24. The lower end of the center opening 13 opens into the upper end of a cavity 14 which extends axially through the center of the lower portion of the tip body 10. The lower end of the cavity 14 communicates with an ink chamber 16 formed within an axial sleeve 15 which is mounted on the lower end of the tip body 10. As is conventional, a relay core 17 comprising an assembly of porous members such as a fiber bundle or an assembly of thin rods is located between the cavity 14 and the top of the ink chamber 16. The ink chamber and the relay core are constituted as same as in the conventional ball-point pen using a water soluble ink, for example, as shown in British Pat. No. 1,139,038.

A plurality of axially and radially extending larger ribs 18 project from the inner surface of the center opening 13 and are spaced apart circumferentially at a suitable spacing. The radial length projection of the larger ribs 18 is chosen such that their radially inner end faces 19 do not contact each other, but are spaced from each other by a suitable gap. The radial length of these ribs 18 gradually decrease in a direction toward the cavity 14. A second plurality of axially and radially extending smaller ribs 20 also project from the inner surface of the center opening 13, and are interleaved or alternately disposed with the larger ribs 18. The radial length of the smaller ribs 20 is less than that of adjacent larger ribs 18 and hence their radially inner end faces 21 are retracted from adjacent end faces 19 of the larger ribs 18. The axial length of the smaller ribs 20 is also less than that of the larger ribs 18. The upper end face of the larger and smaller ribs 18, 20 is downwardly inclined toward the axis of the pen in order to retain the ball 10 thereon. The width of the respective ribs 18, 20, indicated at w in FIG. 2, remains the same throughout their axial length, but the width of the smaller ribs 20 is reduced as compared with the width of the larger ribs 18 to permit an increased radial length of projection of the larger ribs. It is to be understood that in FIG. 1, the relative axial length of the cavity 14 and the relay core 17 are shown reduced from their actual dimensions relative to the other parts.

The assembly of the larger ribs 18 and the smaller ribs 20 define a plurality of axially extending ink guide grooves or passageways 22 within the center opening 13 which extend in both radial and axial directions. The ink passageways 22 have a cross-sectional shape which converges in the radial inward direction. It will be noted that these ink passageways 22 are gradually narrowed center toward the center axis and also in the axial direction toward the ball retainer 12 so that the ink which is supplied by the ink chamber 16 and which passes through the relay core 17 and along the end faces 19 of the larger ribs 18 can be smoothly led into the bottom of the recess 24 where it is positively supplied to the ball 11 through the upper end of the individual passageways 22 and through a central bore 23 defined by the inner end faces 19 of the larger ribs 18. The center opening 13 and the plurality of larger and smaller ribs 18, 20 define an ink guide passage or opening for guiding and directing the ink from the ink chamber 16 to the ball 11.

Figure 3:
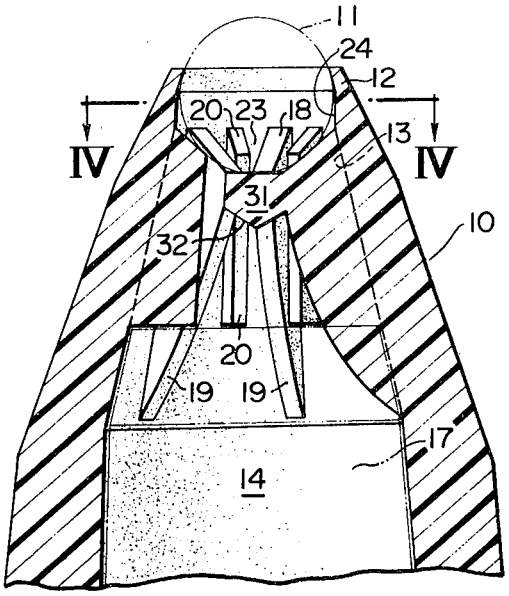
FIG. 3 is a longitudinal section of a tip of a ball-point pen according to a second embodiment of the invention.
Figure 4:
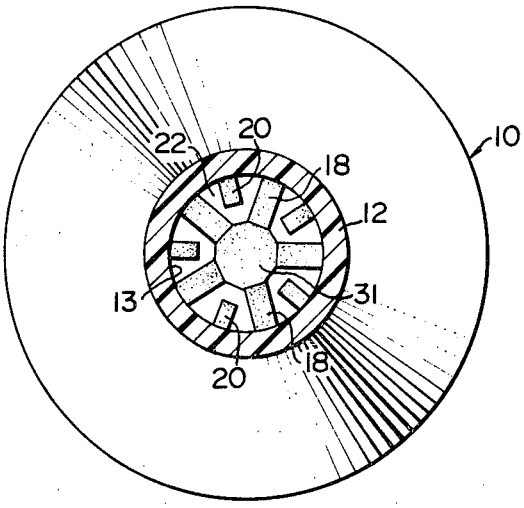
FIG. 4 is a cross section taken along the line IV—IV shown in FIG. 3.

FIGS. 3 and 4 show a second embodiment of the invention where corresponding parts are designated by like reference numerals as used in the first embodiment. As in the first embodiment, a plurality of larger and smaller ribs 18, 20 are integrally formed with the tip body 10 on the inner surface of the center opening 13 which is conically tapered, thus defining the ink passageways guide grooves 22. In the second embodiment, the radially inner end faces of the larger ribs 18 are integrally connected with each other at the upper end thereof so as to close the central bore 23 shown in FIG. 2, thus providing a central abutment 31. The bottom of the central abutment 31 is formed with inclined surfaces 32 to present a tapered surface toward the cavity 14. As a consequence, the ink passing through the relay core 17 in a region adjacent to the axis flows along the inclined surfaces to be supplied to the ball at the bottom of the recess 24 of the ball retainer 12 through opening slots defined between the larger and smaller ribs 18, 20. In this embodiment, the upper end faces of both sets of ribs 18, 20 and the central abutment 31 constitute together a ball abutment of an increased abrasion strength.

From the foregoing description, it will be appreciated that with the ball-point pen tip of the invention, there is provided within a central opening which provides a communication between a ball and an ink chamber, a plurality of guide grooves or passageways having a gradually decreasing width toward the axis to provide a capillary action having a magnitude which increases as the axis is approached, thereby allowing the ink to be fed toward the center of the bottom of the ball retainer. Because these guide grooves have a greater width at their radially outer end, any fragment of paper which may be produced as the paper is rubbed by the ball during the writing process and which may find its way into the guide grooves will only cause a plugging of portions thereof which have a reduced width without causing an overall plugging over the entire radial extension thereof, thus preventing an interrupted ink flow due to such plugging. The guide grooves have a width which also gradually increases in the direction toward the ink chamber, thereby allowing a sufficient quantity of ink to be maintained within these grooves to prevent an interrupted supply of ink to the center opening.

In the embodiments described above, the entire tip is integrally molded from a synthetic resin. However, alternatively, only the ball retainer and the portion of the center opening which is provided with the ribs may be formed of a synthetic resin, and can be fitted into a metal tube to provide a tip body. In the first embodiment, the smaller ribs may have the same axial length as the larger ribs. The number of the larger and smaller ribs is five in both the first and second embodiments to provide the guide grooves, but it is to be understood that the number of ribs is not limited to such value.

What is claimed is:

1. A ball-point pen for use with a water soluble ink comprising: a tip having a ball retainer at its axially front end which is formed with a cup-shaped recess; a ball rotatably disposed in said cup-shaped recess; an ink guide opening extending through the bottom of the recess and communicating with the rear end of the tip; and an axial sleeve having an ink chamber formed therein which communicates with the ink guide opening, the ink guide opening having a center opening and a plurality of axially and radially extending ribs projecting from the inner surface of the tip which defines the center opening, the ribs comprising a plurality of larger ribs and a plurality of smaller ribs interleaved with the larger ribs, the smaller ribs having a radial length of projection which is less than that of the larger ribs, the larger and smaller ribs both having a substantially uniform width along their axial extent, the center opening having a diameter which gradually reduces in the direction from the ink chamber toward the recess, and the plurality of ribs being configured such that the distance between adjacent ribs gradually narrows in the radial inward direction from the inner surface which defines the center opening toward the center axis of the center opening.

2. A ball-point pen according to claim 1 in which the smaller ribs have an axial length which is less than that of the larger ribs, whereby the lower end of the smaller ribs terminate short of the lower end of the larger ribs.

3. A ball-point pen according to claim 2 in which the upper ends of the individual larger ribs are integrally connected together to define an abutment for the ball.

4. A ball-point pen according to claim 3 in which the larger ribs have a radial length of projection which gradually increases in the direction from the ink chamber toward the recess.

5. A ball-point pen according to any one of claim 4 in which the larger ribs have a radial length of projection which gradually increases in the direction from the ink chamber toward the recess.

6. In a ball-point type pen for use with water soluble ink: a tip having a recess therein configured to rotatably carry a ball; a ball rotatably disposed in the recess; means defining an ink chamber for storing water soluble ink during use of the pen; and means defining an axially extending ink guide passage opening at one end into the recess and communicating at the other end with the interior of the ink chamber, the ink guide passage comprising an axially extending center opening having a tapered shape which gradually converges in the axial direction from the ink chamber toward the recess, and means dividing the center opening into a plurality of axially extending ink passageways circumferentially spaced apart about the center opening, the ink passageways having a cross-sectional shape which converges in the radial inward direction toward the center axis of the center opening, the means dividing the center opening into a plurality of ink passageways comprising a plurality of axially extending ribs circumferentially spaced apart about the center opening and projecting radially inwardly from the surface which defines the center opening toward the center axis such that each two adjacent ribs define one ink passageway of radially converging cross-sectional shape, the plurality of ribs comprising smaller and larger ribs alternately disposed about the center opening, the smaller ribs having a smaller radial length of projection than the larger ribs, and the larger and smaller ribs both having a substantially uniform width along their axial extent.

7. A ball-point type pen according to claim 6; wherein the larger ribs have a longer axial length than the smaller ribs.

8. A ball-point type pen according to claim 7; wherein the larger ribs have a radial length of projection which diverges in the axial direction from the ink chamber toward the recess.

9. A ball-point type pen according to claim 7; includng means connecting together the upper ends of the larger ribs to define an abutment for the ball.

* * * * *